US009614287B2

(12) United States Patent
Urso et al.

(10) Patent No.: US 9,614,287 B2
(45) Date of Patent: Apr. 4, 2017

(54) MULTI-BAND ANTENNA

(71) Applicant: MOLTOSENSO S.R.L., La Spezia (IT)

(72) Inventors: Marco Francesco Urso, Mattie (IT); Andrea Merli, Turin (IT)

(73) Assignee: MOLTOSENSO S.R.L., Turin (IT)

( * ) Notice: Subject to any disclaimer, the term of this patent is extended or adjusted under 35 U.S.C. 154(b) by 0 days.

(21) Appl. No.: 14/653,444

(22) PCT Filed: Dec. 16, 2013

(86) PCT No.: PCT/IB2013/060989
§ 371 (c)(1),
(2) Date: Jun. 18, 2015

(87) PCT Pub. No.: WO2014/097118
PCT Pub. Date: Jun. 26, 2014

(65) Prior Publication Data

US 2015/0325920 A1 Nov. 12, 2015

(30) Foreign Application Priority Data

Dec. 18, 2012 (IT) ..... TO2012A1097

(51) Int. Cl.
*H01Q 9/28* (2006.01)
*H01Q 9/26* (2006.01)
(Continued)

(52) U.S. Cl.
CPC ..... *H01Q 9/26* (2013.01); *H01Q 1/38* (2013.01); *H01Q 5/371* (2015.01); *H01Q 5/40* (2015.01);
(Continued)

(58) Field of Classification Search
CPC ..... H01Q 9/285; H01Q 3/44; H01Q 21/12; H01Q 9/16; H01Q 9/42; H01Q 11/08; H01Q 9/26
(Continued)

(56) References Cited

U.S. PATENT DOCUMENTS 7,692,600 B1 4/2010 Pakosz et al.
2002/0084937 A1 7/2002 Shinichi
(Continued)

FOREIGN PATENT DOCUMENTS

EP 0884796 A2 12/1998
GB 2 347 792 A * 9/2000 ..... H01Q 1/12
(Continued)

OTHER PUBLICATIONS

International Search Report for corresponding International Patent Application No. PCT/IB2013/060989, mailed Apr. 15, 2014.
(Continued)

*Primary Examiner* — Joseph Lauture
(74) *Attorney, Agent, or Firm* — Merchant & Gould P.C.

(57) ABSTRACT

A multi-band antenna can be associated with at least one electronic device. The antenna includes a single power supply point; at least one first resonant circuit for resonating at a first frequency; and at least one second resonant circuit for resonating at a second frequency. The resonant circuits are electrically connected to each other. The connection point between the resonant circuits corresponds to the single power supply point. The antenna can be used simultaneously over multiple bands.

14 Claims, 4 Drawing Sheets

(51) Int. Cl.

| | |
|---|---|
| ***H01Q 1/38*** | (2006.01) |
| ***H01Q 5/50*** | (2015.01) |
| ***H01Q 9/27*** | (2006.01) |
| ***H01Q 21/30*** | (2006.01) |
| ***H01Q 5/371*** | (2015.01) |
| ***H01Q 5/40*** | (2015.01) |
| *H01Q 3/44* | (2006.01) |
| *H01Q 9/16* | (2006.01) |
| *H01Q 21/12* | (2006.01) |
| *H01Q 9/42* | (2006.01) |
| *H01Q 11/08* | (2006.01) |

(52) U.S. Cl.
CPC ..... *H01Q 5/50* (2015.01); *H01Q 9/27* (2013.01); *H01Q 9/285* (2013.01); *H01Q 21/30* (2013.01); *H01Q 3/44* (2013.01); *H01Q 9/16* (2013.01); *H01Q 9/42* (2013.01); *H01Q 11/08* (2013.01); *H01Q 21/12* (2013.01)

(58) Field of Classification Search
USPC ..... 343/795, 700, 821, 751, 895, 806, 828, 343/843
See application file for complete search history.

(56) References Cited

U.S. PATENT DOCUMENTS

| | | | |
|---|---|---|---|
| 2004/0183728 | A1 | 9/2004 | Zinanti et al. |
| 2009/0256762 | A1 | 10/2009 | Weakley |
| 2012/0176289 | A1 | 7/2012 | Lee |

FOREIGN PATENT DOCUMENTS

| | | | |
|---|---|---|---|
| GB | 2347792 | A | 9/2000 |
| WO | WO 2005/062422 | A1 | 7/2005 |

OTHER PUBLICATIONS

IEEE Standards Association: "IEEE Standard for Local and metropolitan area networks—Part 15.4: Low-Rate Wireless Personal Area Networks (LR-WPANs)", IEEE Computer Society, New York, NY, Sep. 5, 2011 (Sep. 5, 2011), 314 pages.

* cited by examiner f2=2,4GHz f1=868MHz f2=2,4GHz f1=868MHz

MULTI-BAND ANTENNA

This application is a National Stage Application of International Patent Application No. PCT/IB2013/060989, filed Dec. 16, 2013, which claims benefit of Serial No. TO2012A001097, filed Dec. 18, 2012 in Italy and which application(s) are incorporated herein by reference. To the extent appropriate, a claim of priority is made to each of the above disclosed applications.

BACKGROUND OF THE INVENTION

The present invention relates to a multi-band antenna, preferably a dual-band one. Said antenna is preferably formed on a printed circuit board (PCB).

In particular, the antenna according to the present invention is designed for communicating within two electromagnetic spectrum portions reserved for non-commercial radiocommunication applications, normally referred to as ISM (Industrial, Scientific and Medical) or SRD (Short Range Device) bands. More in detail, the antenna according to the present invention is preferably adapted to operate in bands around the 868 MHz frequency, called European SRD band, the 915 MHz frequency, called ISM band, and the 2.4 GHz frequency, also called ISM band.

It is known that the free ISM and SRD frequencies are widely used for short-range data transmission in applications such as, for example, remote monitoring and control, such as wireless sensor and actuator networks (WSN/WSAN), telemetry, alarm systems, etc. These bands are used by several low-data rate and high-data rate communication standards, such as Wi-Fi, IEEE 802.15.4, Bluetooth, ZigBee, etc.

The devices adapted to communicate over said bands lead to applications developed through highly pervasive and device-dense systems; since said bands are widely used, they require that the cost of the device itself, and hence of the antenna which is a part thereof, is low.

In particular, in this field it is desirable to create a low-cost antenna that can be associated with consumer electronic devices.

Electronic devices, e.g. wireless ones, capable of operating over two or more ISM/SRD bands, are normally equipped with two or more antennae, which are substantially independent and distinct, and which are adapted to be selectively powered for the purpose of energizing the resonance modes of either antenna, depending on the frequency at which the device needs to communicate.

The duplication of the electronic devices and of their control logic leads to higher costs incurred for manufacturing and assembling the electronic device and to higher complexity of the device's control program, which is more subject to programming errors and bugs.

PCB antennae are also known which can operate at two different frequencies, in that they include two independent antennae arranged on the same layer of insulating material or at different levels of a printed circuit.

Even with such integration, however, the problem of selectively controlling the antenna that must be in operation at a certain moment has not been solved.

PCB antennae, or patch antennae, have a directional radiation diagram; in fact, they have the maximum radiation lobe in a direction substantially perpendicular to the surface of the printed circuit board on which the antenna is provided.

Patent applications are also known which describe non-linear antennae wound around themselves, in particular consisting of straight sections so structured as to create a spiral-wound broken line, thus minimizing space occupation.

Another known problem concerns the cross-talk between two near antennae, which, although they operate at different frequencies, interact electromagnetically with each other.

Such problems can be found in patent applications U.S. Pat. No. 7,692,600 and GB2347792.

SUMMARY OF THE INVENTION

The present invention aims at solving the above-mentioned technical problems by providing a PCB antenna which can operate over more than one band without requiring the intervention of any multiplexing devices for selecting the most suitable antenna for the band of interest.

BRIEF DESCRIPTION OF THE DRAWINGS

The features and advantages of the antenna according to the present invention will become apparent from the following patent description of at least one embodiment thereof and from the annexed drawings, wherein:

FIG. 1A is a top view, and FIG. 1B is a side view of the PCB antenna;

FIG. 3A shows the antenna's radiation diagram in the 868 MHz band, and FIG. 3B shows the antenna's radiation diagram in the 2.4 GHz band;

FIG. 4A shows the antenna's radiation diagram in the 868 MHz band, and FIG. 4B shows the antenna's radiation diagram in the 2.4 GHz band.

DETAILED DESCRIPTION OF THE PREFERRED EMBODIMENT(S)

Figure 1A:
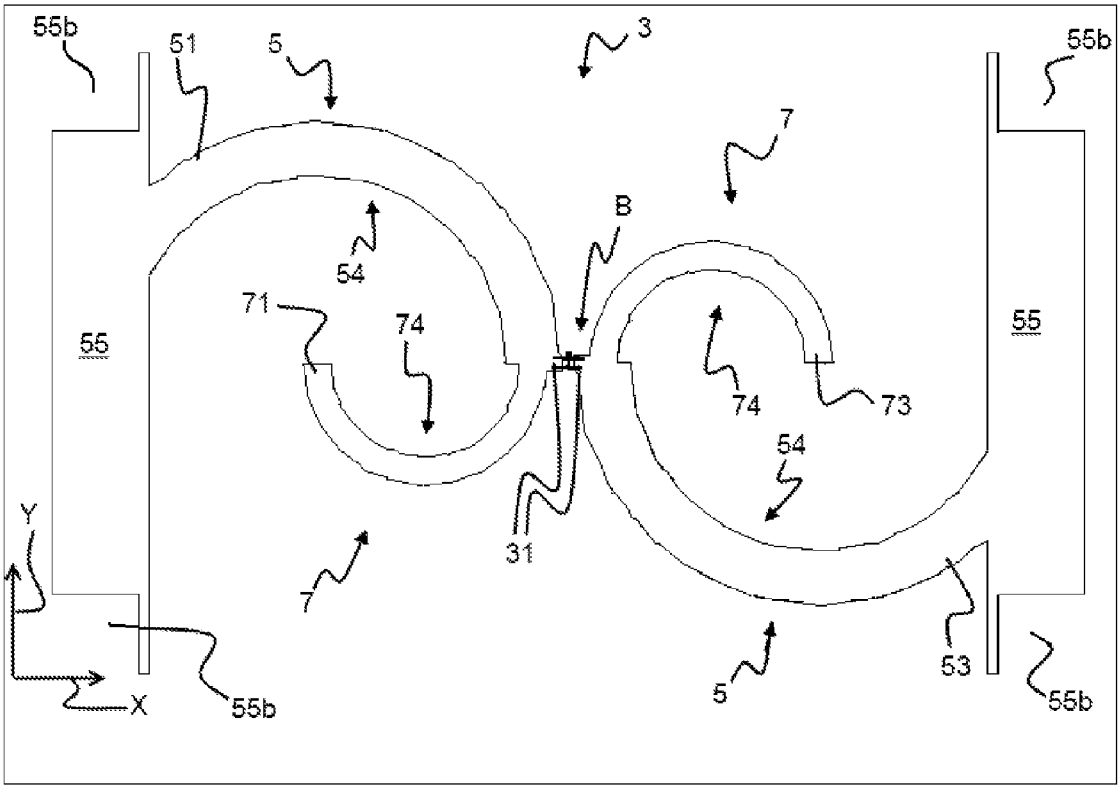
FIGS. 1A and 1B show several views of the antenna of the present invention; in particular.
Figure 1B:
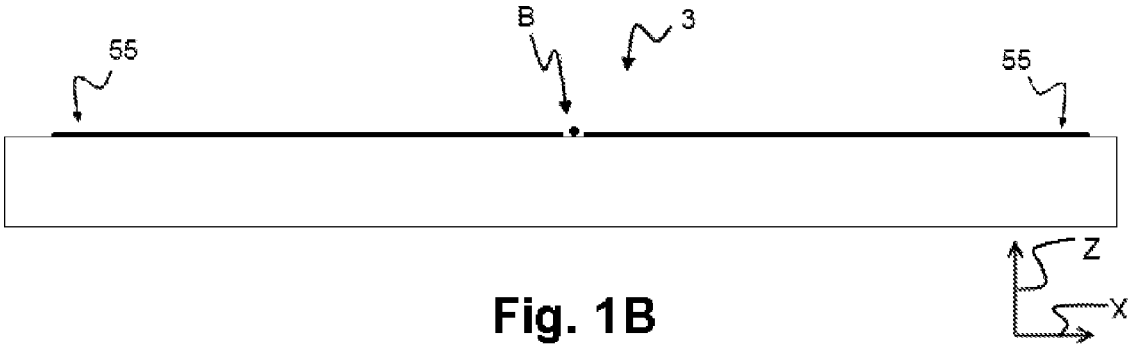

With reference to the above-mentioned drawings, multi-band antenna 3, associable with an electronic device, comprises a single power supply point 31.

Preferably, antenna 3 is designed as a balanced one. If it has to be associated with a floating-mass or single-ended transceiver, the power supply point will in turn be connected to the output terminal of a balun adapter circuit "B".

In general, antenna 3 comprises at least one first resonant circuit 5, preferably adapted to resonate at a first frequency "f1", e.g. in the 868 MHz SRD band, and at least one second resonant circuit 7, preferably adapted to resonate at a second frequency "f2", e.g. in the 2.4 GHz ISM band.

For the purposes of the present invention, the term "resonant circuit" refers to a portion of conductive material adapted to radiate and/or receive an electromagnetic field in a predetermined band of the frequency spectrum.

Figure 2:
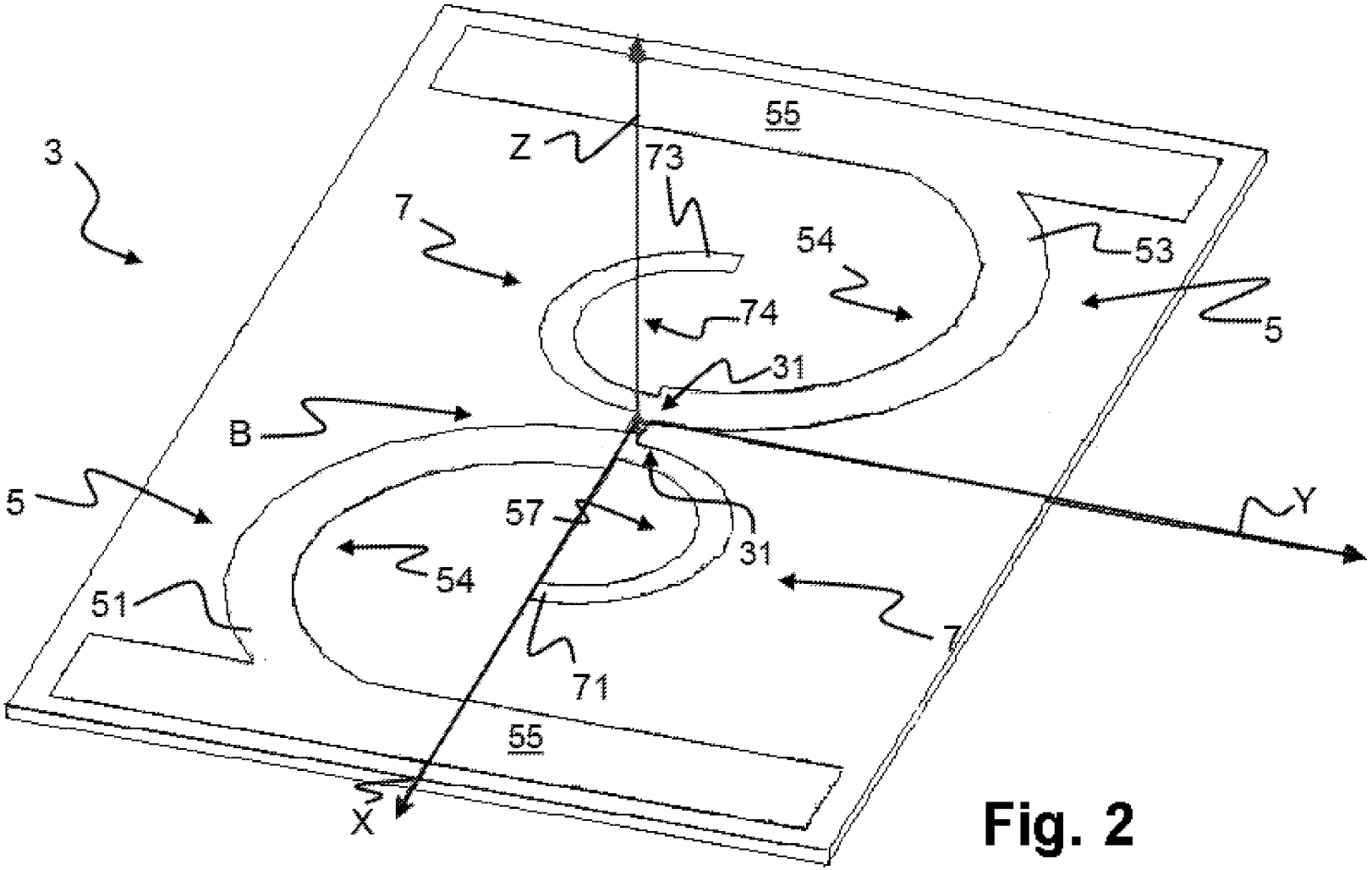
FIG. 2 shows a perspective view of the antenna.

Resonant circuits (5, 7) are electrically connected to each other, and the connection point between the resonant circuits corresponds to the power supply point 31, as shown, for example, in FIG. 1A and FIG. 2. Resonant circuits (5, 7) are energized through said power supply point 31 by forcing a radio-frequency signal in the operating frequency band of each resonant circuit.

Each resonant circuit (5, 7) substantially forms a virtual antenna.

Such a configuration allows antenna 3 to be used simultaneously over multiple bands.

Said resonant circuits (5, 7) are arranged in the same reference plane "XY" defined by a first axis "X" and a second axis "Y", which are perpendicular to each other. In an equivalent embodiment, said resonant circuits (5, 7) are arranged in parallel planes, along a third axis "Z" which is perpendicular to both the first axis "X" and the second axis "Y", wherein the projections of both of said first axis "X" and said second axis "Y", with respect to planes perpendicular to both parallel planes, lie in both parallel planes.

Each resonant circuit (5, 7) comprises at least one curvilinear portion (54, 74).

Said curvilinear portions (54, 74) of resonant circuits (5, 7), lying in the same plane or in parallel planes, are arranged symmetrically; for example, two curvilinear portions comprised in two resonant circuits are arranged symmetrically, preferably specularly, with respect to the first axis "X", e.g. as shown in the drawings. The arrangement of the curvilinear portions of the resonant circuits is such as to minimize the coupling between the same resonant circuits (5, 7).

The radiation diagram of antenna 3 according to the present invention at the operating frequencies (f1, f2) is a function of the radius of curvature of curvilinear portions (54, 74) of the respective resonant circuits (5,7). For these reasons, curvilinear portions (54, 74) will have different radii of curvature as well as different longitudinal extensions, as is clearly visible in FIGS. 1A and 2.

Curvilinear portions (54, 74) of resonant circuits (5, 7) are symmetrical to each other with respect to said first axis "X", thus reducing to a minimum the coupling between resonant circuits (5, 7) and allowing the antenna to be used simultaneously over multiple bands, while minimizing mutual interference.

For the purposes of the present invention, the phrase "curvilinear portions arranged symmetrically and/or specularly with respect to the first axis "X"" means that the shape of the single curvilinear portions is such that the concavities of the symmetrical curvilinear portions are different relative to the axis of symmetry, e.g. as shown in FIGS. 2 and 1A. By way of example, as shown in FIG. 2A, the two curvilinear portions have opposite concavity with respect to the axis of symmetry and/or specularity "X".

In the preferred embodiment, each resonant circuit is a dipole comprising two arms, respectively a first arm (51, 71) and a second arm (53, 73). Each one of said arms (51, 53, 71, 73) is electrically connected, at one end, to the power supply point (31).

In the preferred embodiment, said antenna is a dual-band one. Said embodiment, therefore, only includes the first resonant circuit 5 and the second resonant circuit 7.

More in detail, the arms of the two resonant circuits (5, 7) are connected in pairs (51-73, 53-71) to each other, as clearly shown in FIGS. 1A and 2.

The connection point between the two arms (51-73, 53-71) of the two resonant circuits (5, 7) corresponds to the power supply point 31, as shown in FIG. 1A.

The single dipoles (5, 7) are arranged in the same reference plane "XY". Said reference plane "XY", as aforementioned, is defined by the first axis "X" and by the second axis "Y", which are perpendicular to each other. Said reference plane "XY" corresponds, for example, to the plane defined by the printed circuit board on which the antenna according to the present invention is formed.

In general, the two arms (51-53, 71-73) of each resonant circuit (5, 7) have a central symmetry configuration, e.g. they are arranged in pairs in a specular manner. In particular, as shown by way of example in FIG. 2, the two arms are arranged with central symmetry, e.g. in pairs and specular with respect to the first and second axes (X, Y), which axes are perpendicular to each other and define said reference plane "XY".

For the purposes of the present description, as shown by way of example in FIG. 2, a second arm (53, 73) can be positioned with central symmetry relative to a first arm (51, 71) as follows: starting from the position of said first arm, the arm is turned over relative to the axis of symmetry "X", and it is then turned over again relative to the second axis of symmetry "Y". The intersection point between said first axis "X" and said second axis "Y" defines the centre of symmetry.

The central symmetry arrangement, e.g. in pairs and specular, of the arms (53, 51, 71, 73) of each resonant circuit (5, 7) contributes to reducing the cross-talk coupling between the same resonant circuits.

In general, as shown by way of example in FIG. 1A, the antenna has a structure with central symmetry developed with respect to a point, called origin or point of symmetry, e.g. defined by the intersection of the two axes (X, Y). Being the centre of symmetry of the whole structure, said point or origin is by construction set to null potential or virtual mass.

In general, each arm (51, 53, 71, 73) of each resonant circuit comprises at least one curvilinear portion (54, 74).

In general, said curvilinear portion (54, 74) constitutes the biggest part of each resonant circuit (5, 7); for example, each resonant circuit (5, 7) consists entirely of at least one curvilinear portion (54, 74).

Preferably, said curvilinear portion (54, 74) is the biggest part of each arm (51, 53, 71, 73). More preferably, each arm (51, 53, 71, 73) consists entirely of one curvilinear portion (54, 74).

Each curvilinear portion (54, 74) has a known radius of curvature, preferably constant along the whole portion (54, 74). Preferably, curvilinear portion (54, 74), associated with a resonant circuit, is equal for both arms (51, 53; 71, 73) of the same resonant circuit (5, 7), so that, with respect to the other antenna, homologous circuit parts or, in particular, circuit sections are as orthogonal as possible.

The radiation diagram of the antenna according to the present invention at the operating frequencies (f1, f2) is a function of the radius of curvature of curvilinear portions (54, 74) of arms (51, 53, 71, 73) of respective resonant circuits (5, 7).

In general, the arrangement of said at least one curvilinear portion (54, 74) of each resonant circuit (5, 7) is such as to minimize the coupling between resonant circuits (5, 7), thereby allowing the antenna to be simultaneously used over multiple bands, thus reducing any mutual interference between the resonant circuits. In particular, the presence of curvilinear portions, thanks to the orthogonal homologous parts (or sections) thereof, allows to minimize any cross-talk effects between the resonant circuits. In fact, said curvilinear portions are adapted to make the currents flowing in the single resonant circuits orthogonal to each other, thus reducing the coupling.

In the preferred embodiment, the antenna is so designed as to maximize the isotropy of the radiation diagram in all of the frequencies in which the antenna of the present invention can operate. This is achieved thanks to the shape of the antenna, which allows, for the current elements of the resonant circuits, to keep a symmetrical current distribution with respect to the power supply point, which changes direction with continuity so as to cause the radiation diagram to become more isotropic than that of a classic dipole antenna. In addition, the reduction of the coupling between the resonant circuits contributes to increasing the isotropy of each virtual antenna associated with the single resonant circuit. The behaviour of each resonant circuit is substantially identical to that of a similar resonant circuit isolated from any other resonant circuit, i.e. the resonant circuit has a real behaviour, as if there were no other resonant circuits in the vicinity, without being affected by mutual couplings which are normally present in a prior-art multi-band antenna.

Figure 3B:
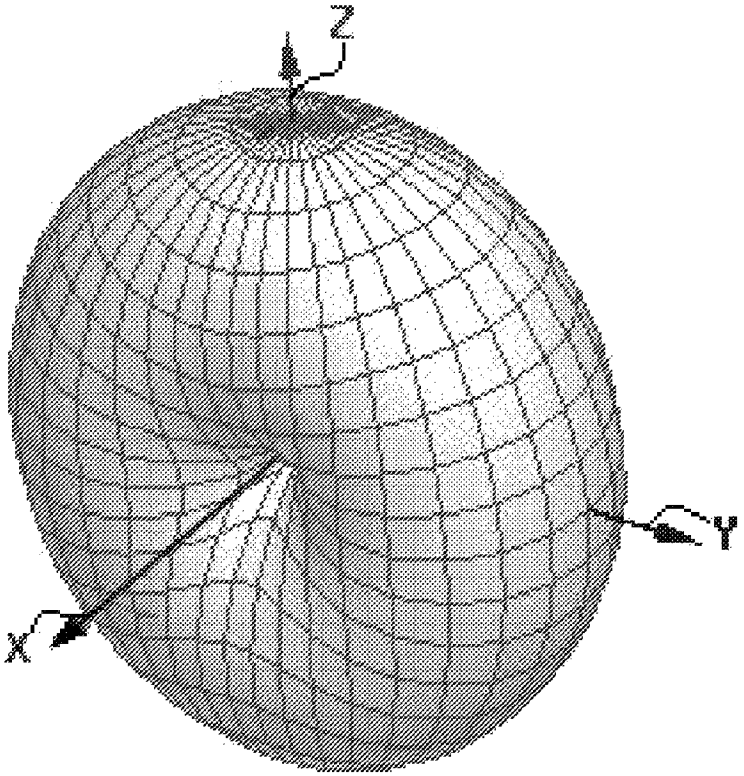
FIGS. 3A and 3B show three-dimensional radiation diagrams of the antenna, obtained by simulation; in particular.
Figure 3A:
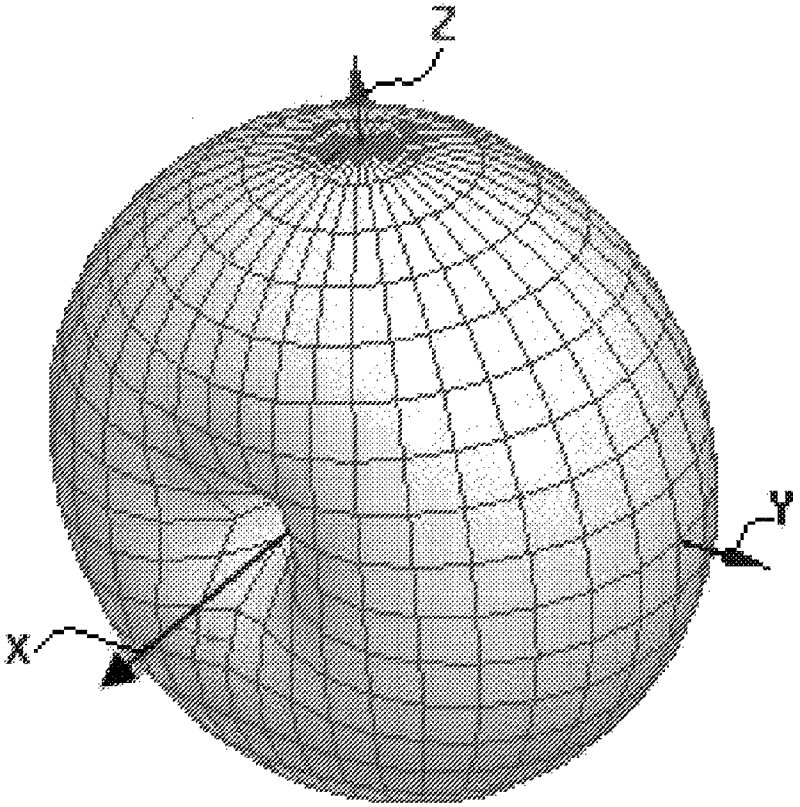

As shown in FIGS. 3A and 3B, the radiation diagram is substantially isotropic.

More in detail, said FIGS. 3A and 3B show a simulation of the antenna according to the present invention, carried out by means of a computer program.

Figure 4B:
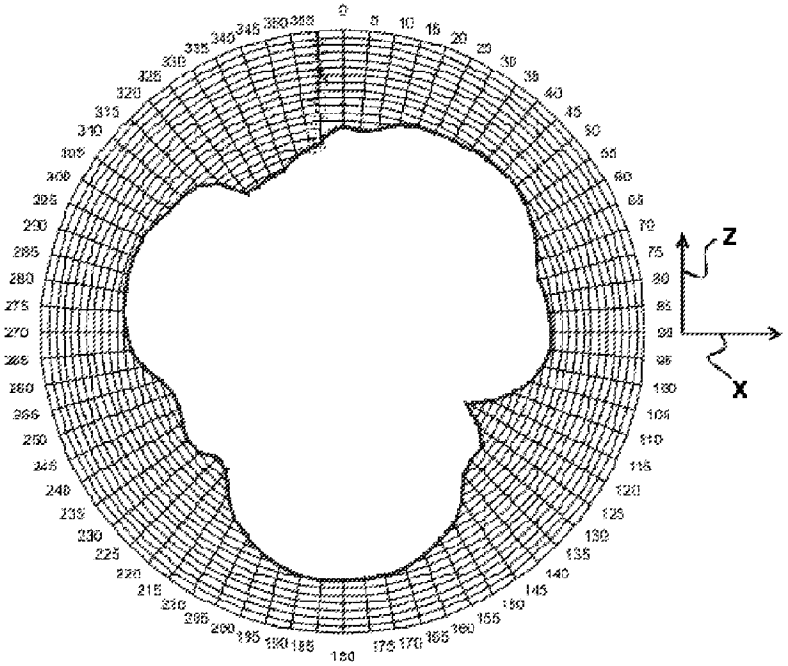
FIGS. 4A and 4B show measured radiation diagrams with reference to the XY plane of the antenna; in particular.
Figure 4A:
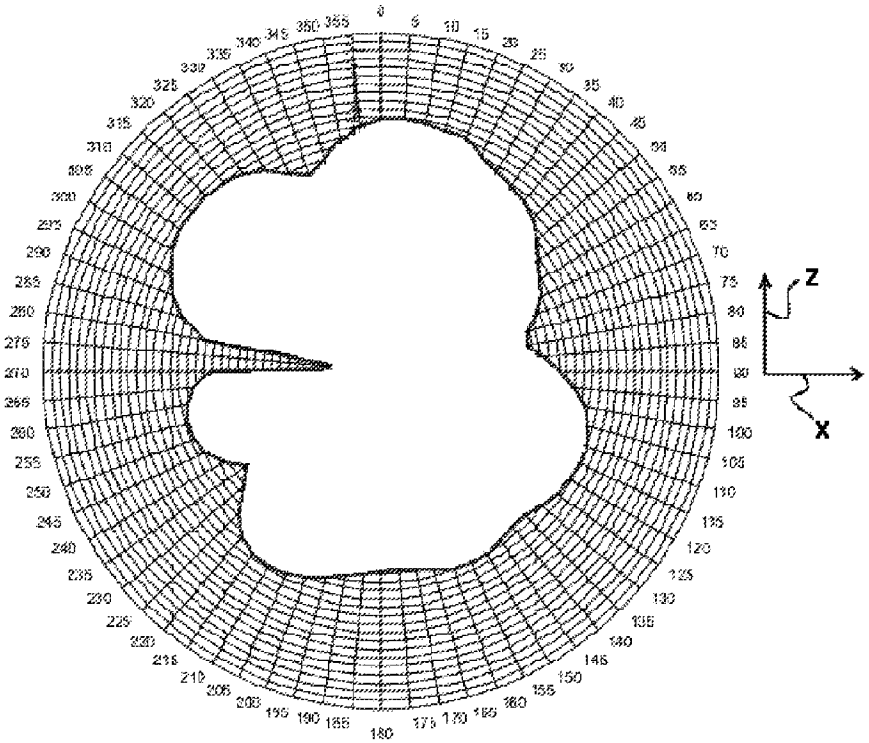

More specifically, at operating frequency "f1" there is a minimum at the first axis "X", corresponding to the longitudinal axis of antenna 3, as proven by the anechoic chamber measurement shown in FIG. 4A. Said minimum is essentially absent, on the contrary, at the second operating frequency "f2", as shown in FIG. 4B, which increases the isotropy of antenna 3 according to the present invention.

In particular, FIGS. 4A and 4B show an anechoic chamber measurement of the transmission behaviour of the antenna in a section of the 3D radiation diagram shown in FIGS. 3A, 3B. The diagram of FIGS. 4A, 4B is obtained by turning the antenna about the second axis "Y". More specifically, FIGS. 4A and 4B show the radiation diagram with respect to a second reference plane "XZ", which is defined by said first axis "X" and by a third axis "Z". Said third axis "Z" is perpendicular to both said first axis "X" and said second axis "Y". The minimum is located in the radiation diagram along axis "X"; such a behaviour resembles the behaviour of a dipole whose minimum or zero is found at its longitudinal axis.

The anechoic chamber measurements thus show the proper operation of the antenna according to the present invention, demonstrating that both resonant circuits can be powered simultaneously without interacting with each other.

Preferably, the whole antenna 3 is symmetrical, preferably with central symmetry, e.g. with a specular dual arrangement, with respect to the orthogonal axes that define reference plane "XY".

In the preferred embodiment, as aforementioned, the preferred operating frequencies of the antenna according to the present invention are the 868 MHz and 2.4 GHz ISM/SRD bands.

Preferably, the first resonant circuit 5 is adapted to resonate in the 868 MHz SRD frequency band. Instead, the second resonant circuit 7 is adapted to resonate in the 2.4 GHz ISM frequency band.

In general, in order to allow the first resonant circuit 5 to operate at frequency "f1", the same first resonant circuit 5 is capacitively charged. The first resonant circuit 5 is capacitively charged by connecting, to the end of circuit 5 opposite to power supply point 31, an electric conductor 55 having a larger surface than the resonant circuit itself. Electric conductor 55 is applied to one end of each arm (51, 53) of the first resonant circuit 5.

More in detail, such a configuration is implemented in the preferred embodiment by connecting one end of each curvilinear portion 54, forming an arm (51, 53), to power supply point 31 as well as to the corresponding branch of the second resonant circuit 7, whereas at its second end it is electrically connected to a second portion 55, made of conductive material. In the preferred embodiment, said second portion 55 has a longitudinal shape substantially arranged along the direction of one axis forming reference plane "XY". More in detail, each second portion 55 is substantially aligned with or parallel to the second axis "Y", as shown in FIG. 1A and FIG. 2.

In the embodiment shown in FIG. 1A, in the proximity of each one of said second portions 55 there is, at the longitudinal ends of said second portions, a fastening area 55*b* with no conductive material. In said fastening areas 55*b*, holes can be drilled in said printed circuit board without jeopardizing the antenna's functionality, for the purpose of fastening the antenna through suitable fastening means, such as screws or bolts or glue or anchors, to the structure of the device in which it will have to operate. Said areas turn out to be aligned with the fastening areas of most off-the-shelf enclosures having the same size as the antenna.

In general, the geometry used for designing the curvilinear portions (54, 74) of conductive material is such as to substantially create a semicircumference, with a curvature of 160° to 200°, preferably 180°.

In addition to minimizing space occupation, such a design also allows to reduce the electromagnetic coupling, such as cross-talk, between resonant circuits (5, 7), by reducing the coupling between the two single virtual antennae.

The shape of resonant circuits (5, 7) also allows to exploit other frequency bands, for more versatility, by making appropriate configuration changes, for example by adding further resonant circuits connected to one another, etc., e.g. by means of a sunburst structure, preferably while still using the central symmetry arrangement.

In general, when a single resonant circuit (5, 7) or, more specifically, when a corresponding arm resonates at its operating frequency, the other resonant circuits comprised in the antenna according to the present invention are also immune to the harmonic frequencies of the resonance frequency. In fact, in addition to not being energized at the operating frequencies of the other resonant circuits that constitute the antenna, the single resonant circuits are not energized by the harmonic frequencies of the resonance frequency of the single circuits. These shape and arrangement allow therefore to minimize the couplings, i.e. the mutual charging occurring between a resonant circuit (or arm) and the other. In fact, since in its preferred but non-limiting embodiment this is essentially a hertzian dipole, the currents flowing in resonant circuits (5, 7) are substantially orthogonal to each other at the centre of the antenna, where the current distributions in each resonant circuit, or arm, are greater, i.e. near the power supply point.

Said curvilinear portion (54, 74) is therefore suitable for causing the currents of each resonant circuit (5, 7) to be orthogonal to each other, thereby reducing the coupling.

Also the electric and/or magnetic field components generated by the current in said resonant circuits (5, 7) are perpendicular to each other, and there is no coupling because the scalar product is null.

The perpendicularity between the current flowing in the resonant circuits (5, 7) prevents the same currents from energizing the modes of the neighbouring circuit. As is visible in the top view shown in FIG. 1A, in the preferred embodiment antenna 3 is formed by two substantially semicircular, e.g. spiral-shaped, structures, arranged with central symmetry, e.g. in pairs and in a specular manner, with respect to the first and second axes (X, Y) that define the reference plane "XY".

Power supply point 31 of the antenna is preferably located where the two semicircle-shaped or spiral-shaped structures are closest.

The single semicircle-shaped or spiral-shaped structure consists of a combination of arms (51, 71; 53, 73) of each resonant circuit, whose curvilinear portions substantially form each a semicircle or at least a portion thereof.

In the embodiment shown in FIG. 2, the antenna receives power via a power supply line, for example.

One possible application of the present multi-band antenna 3 consists of wireless monitoring services.

Antenna 3 according to the present invention can be applied to any device that needs an isotropic antenna for receiving or radiating electromagnetic signals over two or more frequency bands.

Unlike other prior-art multi-band antennae, this particular design avoids the need of using an antenna demultiplexer, and both antennae can be powered simultaneously from the same power supply point, where the output of the balun adapter circuit "B" can be connected, if required.

The isotropy of the radiation diagram of the antenna is very high, as shown in FIGS. 3A, 3B, 4A and 4B, so that the latter can be more easily installed in different positions and environments, thus reducing the inevitable position constraints which are typical of PCB or microstrip antennae.

The solution proposed by the present invention provides significant savings as concerns the antenna's design and manufacturing costs; in fact, in spite of its small dimensions, the antenna still ensures a substantially isotropic radiation diagram and reduced cross-talk interference between the resonant circuits. The small dimensions allow antenna 3 to be used in applications where space saving is a priority.

This surface reduction and the minimization of the discrete components required for the proper operation of the antenna lead to considerably lower production costs, which have a positive impact on the costs of the wireless device with which multi-band antenna 3 is to be associated.

In the embodiment wherein a Balun is required in order to adapt the antenna to an unbalanced-output transceiver, said Balun is preferably a broadband one, so that it can be used in all of the frequency bands in which the multi-band antenna 3 operates.

The use of a single broadband Balun to be optionally associated with antenna 3 allows to reduce even further the production and implementation costs of antenna 3 of the present invention.

Finally, the production of a single multi-band antenna facilitates warehouse management.

The antenna, called "SAXON" by the Applicant, is an easy-to-use, general purpose unit that costs less than any other solution currently available on the market.

Furthermore, thanks to its structural arrangement, the antenna according to the present invention allows to minimize the coupling, e.g. cross-talk, between the resonant circuits, so that it can be simultaneously used over multiple bands without mutual interference.

REFERENCE NUMERALS

Antenna 3
Power supply point 31
First resonant circuit 5
First arm 51
Second arm 53
Curvilinear portion 54
Linear portion 55
Fastening area 55*b*
Second resonant circuit 7
First arm 71
Second arm 73
Curvilinear portion 74
Balun adapter circuit B
First frequency f1
Second frequency f2
Reference plane XY
Second reference plane XZ
First axis X
Second axis Y
Third axis Z

The invention claimed is:

1. A multi-band antenna, associable with at least one electronic device, said antenna comprising:
- a single power supply point;
- at least one first resonant circuit for resonating at a first frequency;
- at least one second resonant circuit for resonating at a second frequency;
- said resonant circuits are electrically connected to each other and a connection point between the resonant circuits corresponds to the power supply point;
- wherein:
  - each resonant circuit comprises at least one curvilinear portion;
  - said curvilinear portions of the resonant circuits are arranged symmetrically with respect to a first axis, such that coupling between the same resonant circuits is minimized;
  - a radiation diagram of the antenna at the first and second frequencies is a function of a radius of curvature of the curvilinear portions of the respective resonant circuits;
  - wherein said resonant circuits are arranged in a same reference plane defined by said first axis and by a second axis orthogonal to said first axis.

2. An antenna according to claim 1, wherein:
- each resonant circuit is a dipole comprising two arms, respectively a first arm and a second arm;
- each one of said arms-is electrically connected, at one end, to the single power supply point.

3. An antenna according to claim 2, wherein each arm of each resonant circuit comprises at least one curvilinear portion.

4. An antenna according to claim 2, wherein:
- the antenna is a dual-band one;
- the arms of the two resonant circuits are connected in pairs to each other;
- the connection point between the two arms of the two resonant circuits corresponds to the power supply point.

5. An antenna according to claim 2, wherein the antenna has a structure with central symmetry, developed with respect to a point having null potential or virtual mass.

6. An antenna according to claim 1, wherein the two arms of each resonant circuit are arranged with central symmetry.

7. An antenna according to claim 1, wherein said curvilinear portions are arranged to cause the radio-frequency signals for energizing modes of the single resonant circuits to be orthogonal to each other, thereby reducing coupling and cross-talk.

8. An antenna according to claim 1, wherein the first resonant circuit is capacitively charged.

9. An antenna according to claim 8, wherein said balun adapter circuit is a broadband circuit.

10. An antenna according to claim 1, wherein the power supply point is connected to an output terminal of a balun adapter circuit.

11. An antenna according to claim 1, wherein geometry used for designing each curvilinear portion of conductive material creates a semicircumference, with a curvature of 160° to 200°.

12. An antenna according to claim 1, wherein a shape of the single curvilinear portions is such that the concavities of the curvilinear portions, which are symmetrical to each other, are different from each other with respect to an axis of symmetry.

13. A multi-band antenna, associable with at least one electronic device, said antenna comprising:

a single power supply point;

at least one first resonant circuit for resonating at a first frequency at least one second resonant circuit for resonating at a second frequency;

said resonant circuits are electrically connected to each other and a connection point between the resonant circuits corresponds to the power supply point;

wherein:

each resonant circuit comprises at least one curvilinear portion;

said curvilinear portions of the resonant circuits are arranged symmetrically with respect to a first axis, such that coupling between the same resonant circuits is minimized;

a radiation diagram of the antenna at the first and second frequencies is a function of a radius of curvature of the curvilinear portions of the respective resonant circuits;

wherein said curvilinear portions are arranged to cause the radio-frequency signals for energizing modes of the single resonant circuits to be orthogonal to each other, thereby reducing coupling and cross-talk.

14. A multi-band antenna, associable with at least one electronic device, said antenna comprising:

a single power supply point;

at least one first resonant circuit for resonating at a first frequency at least one second resonant circuit for resonating at a second frequency;

said resonant circuits are electrically connected to each other and a connection point between the resonant circuits corresponds to the power supply point;

wherein:

each resonant circuit comprises at least one curvilinear portion;

said curvilinear portions of the resonant circuits are arranged symmetrically with respect to a first axis, such that coupling between the same resonant circuits is minimized;

a radiation diagram of the antenna at the first and second frequencies is a function of a radius of curvature of the curvilinear portions of the respective resonant circuits;

wherein concavities of the single curvilinear portions are symmetrical to each other, and the concavities are different from each other with respect to an axis of symmetry.

* * * * *